United States Patent [19]

Scott

[11] 4,265,571

[45] May 5, 1981

[54] CABLE SLING FOR SUPPORT AND STABILIZATION OF UNDERGROUND OPENINGS

[75] Inventor: James J. Scott, Rolla, Mo.

[73] Assignee: Midcontinent Specialties Manufacturing, Inc., Rolla, Mo.

[21] Appl. No.: 86,709

[22] Filed: Oct. 22, 1979

[51] Int. Cl.[3] ..... E21D 21/00; E21D 20/00

[52] U.S. Cl. ..... 405/259; 405/288

[58] Field of Search ..... 405/259, 260, 261, 262, 405/288; 85/84, 85, 8.3; 52/153, 155, 165, 166

[56] References Cited

U.S. PATENT DOCUMENTS

| | | | |
|---|---|---|---|
| 2,650,476 | 9/1953 | Crockett | 405/259 X |
| 2,970,444 | 2/1961 | Peter | 405/259 |
| 3,391,543 | 7/1968 | Sweeney et al. | 405/259 |
| 3,913,338 | 10/1975 | Galis | 405/259 X |
| 4,012,913 | 3/1977 | Scott | 85/8.3 X |
| 4,126,004 | 11/1978 | Lindeboom | 85/8.3 X |
| 4,160,615 | 7/1979 | Baldwin | 405/259 |
| 4,167,359 | 9/1979 | Beveridge | 405/259 |

*Primary Examiner*—Dennis L. Taylor

*Attorney, Agent, or Firm*—Gravely, Lieder & Woodruff

[57] ABSTRACT

A cable sling for support and stabilization employing a series of tensioned cable slings in position for actively supporting the mine roof or geologic formation by imposing restraint on the geologic mass at blocking points with the tensioned cables which assert restraints thereon, and wherein the cable slings have anchors adjacent the respective ends which contact the geologic mass for establishing substantial continuous anchorage along the cable sling length engaged with the geologic mass through frictional loading along the length of the anchors, and including auxiliary cementitious and mechanical anchors.

21 Claims, 12 Drawing Figures

CABLE SLING FOR SUPPORT AND STABILIZATION OF UNDERGROUND OPENINGS

BACKGROUND OF THE INVENTION

The field of the present invention is directed principally to apparatus and systems for resisting or preventing the collapse of mine roofs and adjacent material in the sides thereof so as to stabilize such formations. Several types of mechanical and grout anchors have been used in the past to improve the anchorage of mine roof support means and to provide long term stability to the system. Mechanical drive anchors have been used at the top of the anchorage drive points on the cable, and these drive anchors are so designed that they may expand in the bore holes to secure tight anchorage in the rock mass.

A mine roof support system is disclosed in the patent of C. C. White U.S. Pat. No. 3,505,824 issued Apr. 14, 1970, and in this system a series of bent rods are utilized in which the opposite end portions of the rod system is secured in a bore hole and turnbuckle type tension means is applied to the exposed ends in the mine passage. A further application of a rod system for mine passage roof support is disclosed by C. C. White in U.S. Pat. No. 3,509,726 of May 5, 1970. An earlier mine roof support system employing flexible cables is disclosed by C. C. White in U.S. Pat. No. 3,427,811 of Feb. 18, 1969. In this disclosure rod anchor elements are disposed in bore holes in the mine roof and the exposed ends are interconnected by a flexible cable arrangement utilizing a turnbuckle device for imposing tension in the rod-cable system combination. Galis disclosed in U.S. Pat. No. 3,601,994 of Aug. 31, 1971 a roof support system for underground mines having a flexible cable arrangement in which the opposite ends of the cables were anchored by wedging members exerting restricted contact in the surface of the bore holes after the wedging members are driven home to apply desired tension on the cables.

BRIEF DESCRIPTION OF THE INVENTION

This invention is directed to cable sling support and stabilization means for underground openings It is a principal object of the present invention to incorporate, in a flexible cable sling system, attachment mechanisms which serve to anchor the ends of the cable sling and provide positive active contact with the rock or geologic mass to be supported. An additional object of the present invention is to provide an improved flexible cable sling arrangement for stabilizing the geologic mass in underground passages by exerting active preload on the geologic mass.

It is a further object of the present invention to provide an improved arrangement of anchor means which will be capable of developing tension in the cable sling for supporting the material adjacent underground passages for the purpose of establishing long term permanent anchorage means establishing friction contact in the bore holes which receive the anchoring means.

A presently preferred system of support and stabilization means embodies a series of pretensioned cable slings spaced along the underground passage and in which the opposite ends are anchored in bore holes by tensioning mechanisms that provide continuous anchorage by actively loading the geologic mass surrounding the holes in a radial direction along substantially the entire length of the contact area between the anchorage and the bore hole. The anchorage devices may consist of split sleeve means to tension a cable by driving against a drive block, which, in turn embeds an anchor in the bore hole in cementitious material to establish long life anchorage.

The broad scope of the present invention is directed to tensioned sling made up of a flexible cable having its end portions secured in the geologic mass in the roof, sides, pillars and other places where mining or underground operations or the construction of openings in the earth crust are found. While a plurality of cable slings are usually employed or required, they generally have common features. A typical cable sling support means for geologic mass comprises means for positioning the terminal end portions of a cable sling in the geologic mass so that upon exerting tension in the cable sling to provide the intended support a high degree of friction contact in that mass can be developed, and a substantial stable support system will result. The means for exerting tension in the cable sling takes the form of members capable of being compressed into friction contact in the geologic mass and developing predetermined initial tension loading in the cable sling, but able to adjust to excess loading which may be encountered through geologic mass movement.

The present invention may be embodied in variations of the foregoing, all of which will be set forth in greater detail in the following description, which is directed to components in which the split sleeve, cable and other parts are formed of metals having desired characteristics.

BRIEF DESCRIPTION OF THE DRAWINGS

The present invention is illustrated in presently preferred embodiments set forth in the accompanying drawings, wherein.

DETAILED DESCRIPTION OF THE DISCLOSURE

Figure 1:
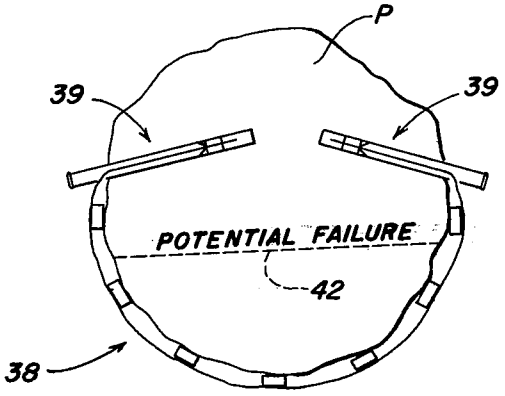
FIG. 1 is a fragmentary sectional view of the sling cable installed in a pillar formation.
Figure 2:
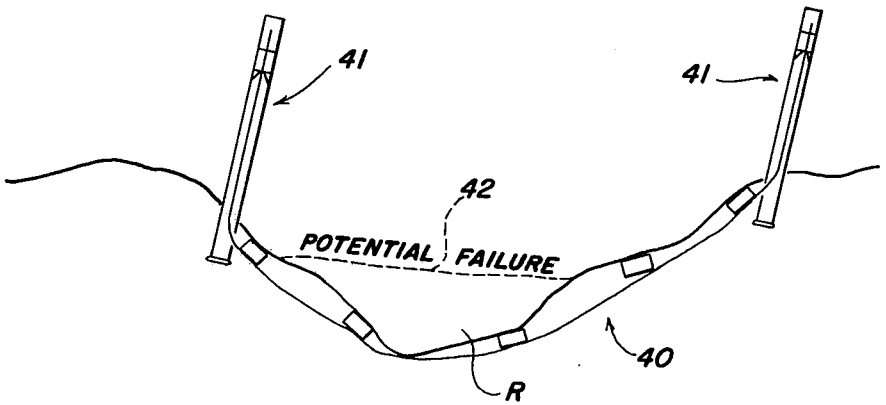
FIG. 2 is a fragmentary sectional view of the sling cable installed in a rib formation.

The invention has been disclosed in certain preferred embodiments in the drawing. For example, in FIG. 1 a cable sling assembly 38 is utilized to support an area of an underground pillar that is suspected of having a potential failure along the line 42. The cable sling 38 is positioned such that its ends are anchored in bore holes in the geologic mass of the pillar P by anchor means 39 having characteristics to be described presently. Another application is shown in FIG. 2 where the cable sling 40 is installed to support and prevent potential failure along the line 42 in the geologic mass of the rib formation R. The ends of the cable sling 40 are suitably anchored by means 41 of the type having characteristics to be described presently.

Figure 3:
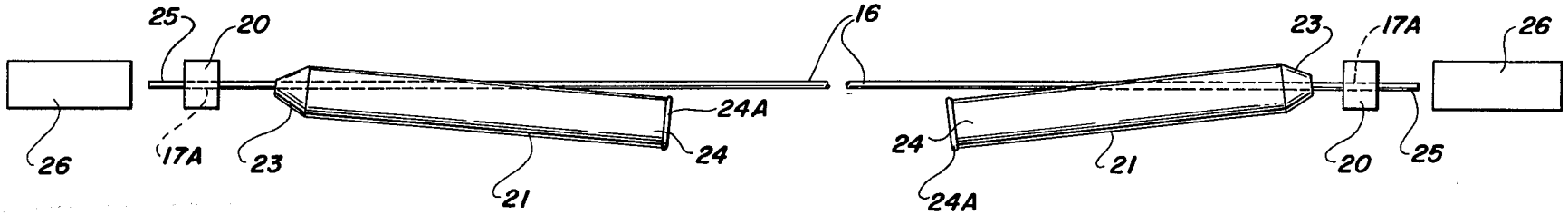
FIG. 3 is a view of the present cable sling assembly showing its components arranged in position prior to installation.

The cable sling is composed of components seen in FIG. 3 where the assembly is laid out prior to installation. The components include a suitable length of cable 16 with drive blocks 20 swaged or locked on to the end portions 17A. The blocks 20 have projecting elements 25 which are adapted in certain instances, to be secured to the bore hole by suitable anchor material made up in a capsule form 26. The assembly also includes split sleeve means 21 having a longitudinal split 22 extending the length thereof from the necked down end 23 to the opposite end 24 which may have a retaining ring 24A positioned at the end. However, the ring 24A may not be necessary when the device for driving the split sleeve is constructed to surround the end 24 and prevent upsetting the material.

Figure 4:
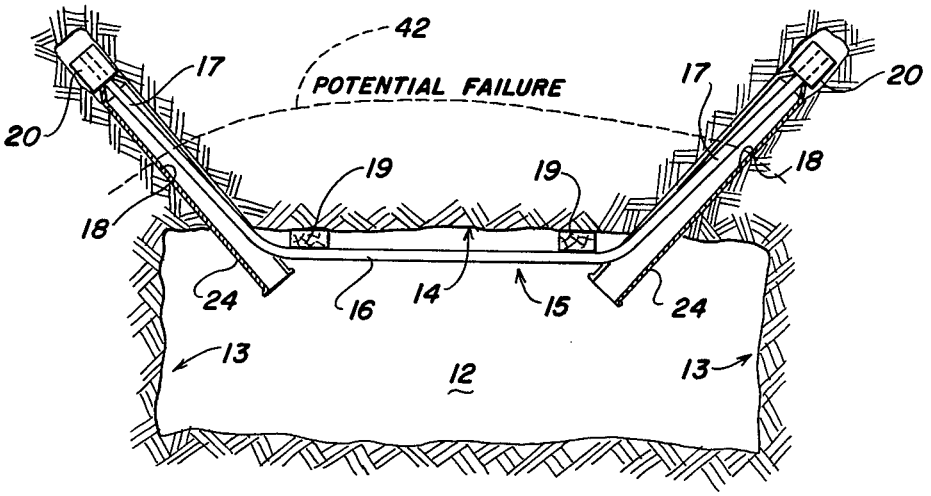
FIG. 4 is a transverse view of an underground passage showing the supporting pillars along each side and a roof support and stabilization cable sling applied to the passage roof.

In FIG. 4 there is shown a section taken transversely of an underground passage 12 having side pillars 13 spanned by a roof 14. It is one purpose of the present invention to provide a roof support system to stabilize the geologic mass of the roof. Such a system is exemplified by the installation of a series of cable slings 15 spaced apart along the passage roof 14 at suitable intervals, so that together they act to support and stabilize the mass of rock or other formation constituting the roof.

A typical cable sling 15 comprises a cable 16 having its opposite ends 17 anchored in bore holes 18 drilled into the roof 14 at angles of about 30° to 60° and located so as to extend above the side pillars 13. Adjacent the entrance to the respective holes 18 are placed header plates 19 which are held by the cable 16. These header plates may be individual blocks at each cable 16 or they may be elongated timbers or steel members to be engaged by several cables.

Figure 5:
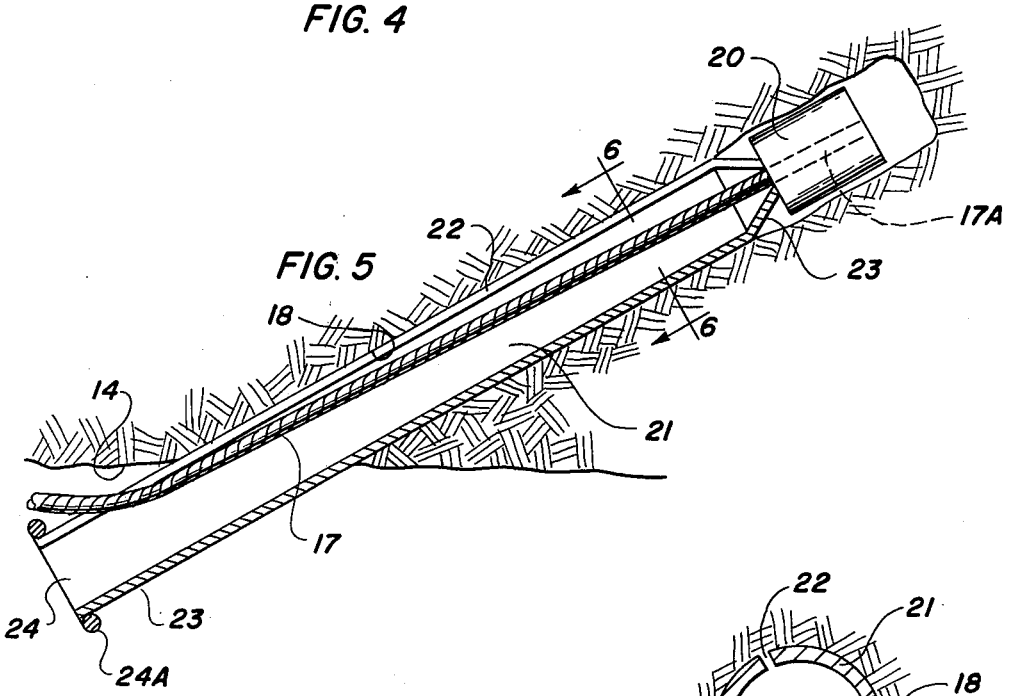
FIG. 5 is a greatly enlarged and fragmentary sectional view of the anchor assembly for one end of the sling cable.
Figure 6:
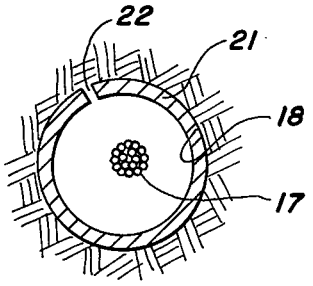
FIG. 6 is a sectional view taken at line 6—6 in FIG. 5.

Turning to FIGS. 5 and 6, there is shown a typical anchor assembly for the opposite ends of the cable sling 15. The assembly comprises an end drive block 20 swaged or locked in place on the cable end 17A. The block 20 is pushed into the hole 18 by a split sleeve 21 which is formed with a longitudinal split 22, and has its lead end necked down at 23 to facilitate initial entrance to the hole 18.

The interior of the split sleeve 21 is clear to receive the cable through the split and surround a cable end portion 17. The split sleeve allows the cable to exit at the mine roof 14. The exposed end 24 of the split sleeve may be provided with a retaining ring 24A. On installing the cable sling 15, one end 17 is passed through the split in sleeve 21 so the block 20 may be driven into the bore hole by the split sleeve end 23. The block is smaller in diameter than the diameter of the bore hole 18, but the unstressed exterior diameter of the split sleeve 21 is slightly larger than the bore hole diameter as set forth in my prior U.S. Pat. No. 3,922,867 of Dec. 2, 1975. A suitable driver (not shown) is utilized to force the split sleeve 21 into position such that it is circumferentially reduced in order to penetrate the hole 18. The depth of penetration is predetermined by the total length of cable 16 needed for the cable sling 15. It is usual to form the bore holes 18 deeper than is needed so that the drive blocks 20 will not bottom out before the desired tension in the cable is reached.

Each cable sling 15 comprises means adjacent the respective ends which can be driven into the mine roof bore holes for developing the desired tension. The retaining and stabilizing means in the form of split sleeves 21 are adapted to actively load the mass of rock and other material in the geologic formation in the roof along the length of the bore holes. The stabilizing means acts to resist rock or roof mass along the length of the bore holes, and they also resist transverse movement, such as occurs on shear failure planes or bedding slip failure planes indicated at 42 which intersect the axis of the bore hole. If transverse movement of the geologic mass occurs in the bore hole in the area of split sleeve contact which overloads the anchor system, slip of small magnitude will occur and forces in the geologic mass will be distributed but anchorage will be restrained. Furthermore, the split sleeve means 21 act to adapt themselves to the shape of the bore hole and develop an increase in the tightness of the fit. Accordingly, the split sleeve means 21 provide an increase in anchorage over and above the initial anchor load, and furthermore the cable has a limited amount of stretch or yield before reaching its ultimate load carrying capacity. Together these components serve to enhance the total yieldability of the cable sling system.

Figure 7:
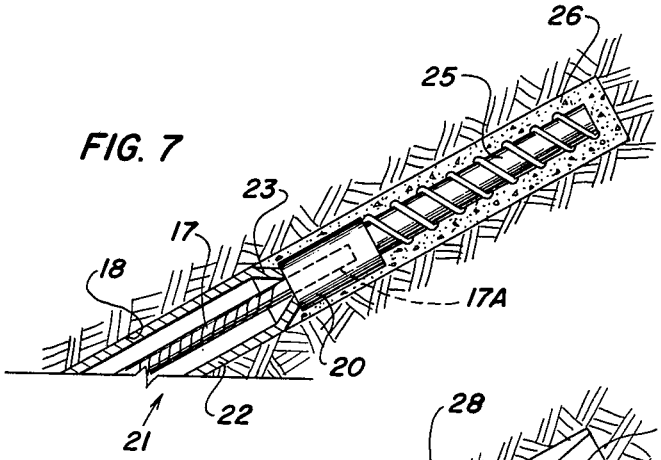
FIG. 7 is a view similar to FIG. 5, but illustrating a modification of the anchor assembly for a sling cable.

Turning now to FIG. 7 there is illustrated, in fragmentary section, a modified anchor means for the cable sling 15. In this view the portion 17 of the cable sling which is positioned in the bore hole 18 is provided with a drive block element 20 which is swaged or locked onto the end 17A of the cable, and a reinforcing bar member 25 is securely attached to the drive block 20 so as to prevent separation under tension that may be exerted by the cable sling 15 as illustrated in FIGS. 1, 2 or 4. The reinforcing bar 25 is seen to be embedded in a suitable cement mixture 26 to increase the resistance to displacement under tension loads exerted by the cable 16. The assembly shown in FIG. 7 is, of course, capable of being employed at both terminal ends 17 of the cable sling 15, or it may be utilized at one end and the anchor means shown in FIG. 5 employed at the opposite end. The cement mixture 26, or an equivalent anchor material, can be first introduced to the bore hole 18 by being placed in capsule form therein. Thereafter, the reinforcing bar 25 is driven into the cement mixture or anchor material by force applied to the friction stabilizing sleeve means 21 so as to develop the required tension in the cable sling 15. The foregoing arrangement allows designs of cable slings to be developed to accept unsymmetrical loads or forces to which the underground opening may be subjected, thereby maximizing the performance of the cable sling to stabilize the geologic mass.

Figure 8:
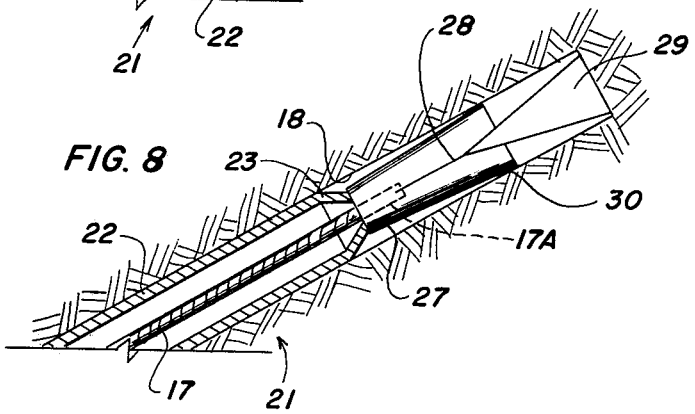
FIG. 8 is a further view of a modification of an anchor assembly for a sling cable.

Another modified means for securing the terminal end portion 17 of the cable sling 15 is shown in FIG. 8. In this assembly the cable portion 17 has its end 17A swaged or locked into a combination split drive-anchor block 27 in which an axially directed split 28 is provided. The combination block 27 is driven into the bore hole 18 and carries with it a wedge element 29 which bottoms out in the bore hole 18. The combination block 27 is forced into the wedge element 29 by a force applied to the split sleeve 21, as before described. In applying a load to the split sleeve 21 the combination block 27 is deformed and applies a radial load on the bore hole surface along the circumferential area 30.

Figure 9:
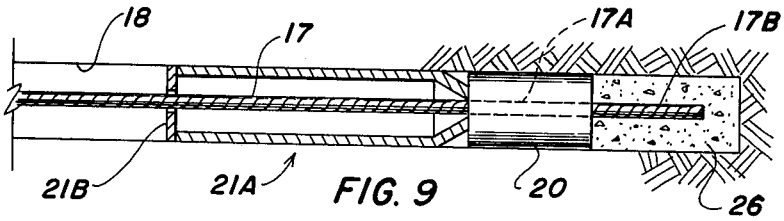
FIG. 9 is still another view of a modified anchor assembly.

Turning now to FIG. 9 there is seen a further modified arrangement for anchoring the end portion 17 of the cable sling 15 in a bore hole 18. In this arrangement the terminal end 17A of the cable projects inwardly beyond the drive block 20 which is then swaged or locked around the cable. Split sleeve means 21 may be utilized to drive the drive block 20 into position, but in this view a short length split sleeve 21A is utilized and is provided with a shoulder 21B against which a driving force may be applied. The exposed projection portion of the cable terminal end 17B is driven into a body of cement or anchor material 26 similar to that shown in FIG. 7.

Figure 10:
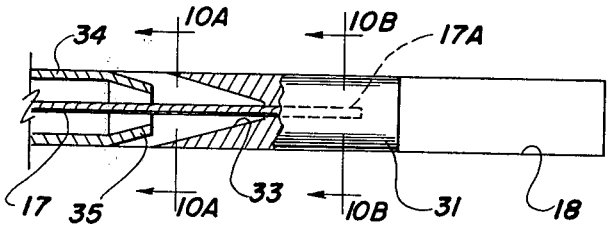
FIG. 10 is a view of a modification for anchoring a sling cable, the view being similar to FIG. 5.
Figure 10A:
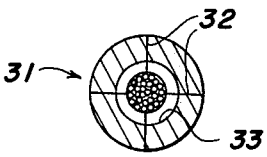
FIGS. 10A and 10B are transverse sectional views taken at lines 10A—10A and 10B—10B in FIG. 10.
Figure 10B:
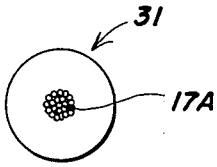

The anchor arrangement shown in FIGS. 10, 10A and 10B embodies an expandable block 31 which is swaged or locked into position on the end portion 17A of the cable terminal end 17, but in this arrangement the expandable block 31 at its trailing end is formed with diametrally directed slots 32 which extend longitudinally and are of a length substantially equal to the tapered mouth 33 in the expandable block 31. The split sleeve 34, which performs an equivalent function to the split sleeve 21, is formed with a tapered end 35 which is adapted to slide into and expand the tapered mouth 33. This formation on the split sleeve 34 causes the split portion of the expandable block 31 to bite into the surfaces of the bore hole 18 so as to substantially lock the cable terminal end 17A in position.

It should now be understood from the foregoing specification that the several means for anchoring the terminal ends of a cable sling achieves an improved result, in addition to serving as the tension mechanism for the cable. Such anchor means, including the split sleeve member, exerts an active loading on the geologic mass along the entire length of the contact area between such sleeve and the surface of the bore hole in which it is placed. The split sleeve members 21 serve to stabilize the anchorage for the cable sling 15 and simultaneously restrict geologic mass movement either lengthwise of the bore hole or transversely thereof. This is an exceptional advantage in that the split sleeve members act to resist shear failure planes or bedding slip failure planes 42 which may intersect the bore hole, as indicated in FIG. 4. Furthermore, the split sleeve members establish yieldable geologic mass support means which can be driven into place at predetermined initial loading but will slip in the bore hole if excessive loads are developed. The present structure provides the unique result that the terminal ends of the cable sling do not lose the anchorage initially established, rather the split sleeve means are capable of undergoing a certain amount of deformation which increases the security that it establishes in the geologic mass.

In the foregoing cable sling, the important characteristics of the split sleeve is that it obtains a frictioned anchor in the geologic mass of sufficient magnitude to tension the cable so that the cable and sleeve applies a restraint or suspension on the geologic mass. This is obtained by adjusting the bore hole size to develop a suitable confinement of the split sleeve for developing anchorage. The adjustment can be obtained by increasing the yield point and/or increasing the wall thickness of the split sleeve. To assure the quality of anchorage, the split sleeve should be deformed in the plastic range because of the inability to drill a uniform bore hole in geologic material. During the installation of the foregoing cable sling there is no rotation induced in the split sleeve or drive block. Normal positioning of the slot in the split sleeve will be such that they will be in generally facing alignment. What is claimed is:

1. In support means for underground passages, the improvement which comprises: cable sling means in the underground passage and having terminal ends penetrating substantially uniform size holes in the material adjacent the underground passage; anchor means engaged with the terminal ends of said cable sling means; and split sleeve members surrounding said cable sling adjacent said anchor means, said split sleeve members being in position for driving said anchor means into the underground passage material and to react in compression upon penetrating the holes in the material for establishing frictional engagement with such material adjacent the underground passage, whereby the cable sling means is tensioned and the anchor means are stabilized in position by said split sleeve members and said split sleeve members actively load the side wall of the holes in the underground passage material radially long substantially the entire length thereof.

2. In support means for underground passages, the improvement which comprises: cable sling means in the underground passage and having terminal ends penetrating the material adjacent the underground passage; anchor means engaged with the terminal ends of said cable sling means, said anchor means comprising a drive block secured to the terminal ends of said cable sling means and having a portion radially expandable into engagement with the underground passage material; and split sleeve members surrounding said cable sling adjacent said anchor means, said split sleeve members being in position for driving said anchor means into the underground passage material and to be compressed into frictional engagement with such material adjacent the underground passage, said split sleeve members having an end portion which radially expands said portion of said drive block concurrently with driving said anchor means into the material adjacent the underground passage, whereby the cable sling means is tensioned and the anchor means are stabilized by said split sleeve members in position and said split sleeve members actively load the underground passage material radially along substantially the entire length thereof.

3. In support means for underground passages, the improvement which comprises: cable sling means in the underground passage and having terminal ends penetrating the material adjacent the underground passage; anchor means engaged with the terminal ends of said cable sling means, said anchor means comprising an expandable block secured onto the terminal end portions of said cable sling means; mechanical means engaged with said expandable block for expanding said anchor means into contact with the underground passage material; and split sleeve members surrounding said cable sling adjacent said anchor means, said split sleeve members being in position for driving said anchor means into the underground passage material and to be compressed into frictional engagement with such material adjacent the underground passage, whereby the cable sling means is tensioned and the anchor means are stabilized by said split sleeve members in position and said split sleeve members actively load the underground passage material radially along substantially the entire length thereof.

4. In support means for underground passages, the improvement which comprises: cable sling means in the underground passage and having terminal ends penetrating the material adjacent the underground passage; anchor means engaged with the terminal ends of said cable sling means, said anchor means comprising a drive block fastened onto the terminal end portions of said cable sling means; means projecting beyond said drive blocks; anchor material engaging said projecting means with said underground passage material; and split sleeve members surrounding said cable sling adjacent said anchor means, said split sleeve members being in position for driving said anchor means into the underground passage material and to be compressed into frictional engagement with such material adjacent the underground passage, whereby the cable sling means is tensioned and the anchor means are stabilized by said split sleeve members in position and said split sleeve members actively load the underground passage material radially along substantially the entire length thereof.

5. The improvement set forth in claim 4, wherein said projecting means is an integral part of said cable sling means.

6. The improvement set forth in claim 4, wherein each of said projecting means is an element having a prepared surface for increasing the strength of the engagement by said anchor material.

7. The improvement set forth in claim 4, wherein each of said projecting means is a length of reinforcing bar stock.

8. Support means applicable for restraining the mass of material in the roof as well as at the sides of an underground passage, said support means comprising: a cable sling having its opposite ends disposed in bore holes directed into the mass of material adjacent the passage; anchor means attached to the respective end portions of said cable sling for reception in the bore holes; and split sleeve means in position driving said anchor means into the bore holes for exerting tension in the cable sling to support the mass of material, each of said split sleeve means consisting of a generally tubular member having a slot extending from end to end and receiving a portion of the cable sling, one end of said tubular member being in driving relation with said anchor means and the opposite end being exposed in the passage for receiving a driving force, and said slot in said tubular member permitting substantial circumferential compression upon insertion of said body into the bore holes and subsequent exertion of frictional engagement with the surrounding surface of the bore hole.

9. The improvement set forth in claim 8, wherein said anchor means comprises: a drive block secured to the ends of said cable sling means and having a portion radially expandable into engagement with the bore hole, and said tubular members have an end portion which radially expands said portion of said drive blocks concurrently with driving said anchor means into the material adjacent the passage.

10. The improvement set forth in claim 8, wherein said anchor means comprises: an anchor block swaged onto the ends of said cable sling; and mechanical means engaged with said anchor blocks for expanding said anchor blocks into contact with the material of said bore holes.

11. The improvement set forth in claim 8, wherein said anchor means comprises: a drive block fastened onto the ends of said cable sling; means projecting beyond said blocks; and anchoring material engaging said projecting means with said material of said bore hole.

12. The improvement set forth in claim 11, wherein said projecting means is an integral part of said cable sling.

13. The improvement set forth in claim 8, wherein each of said projecting means is an element having a prepared surface for increasing the strength of the engagement by said anchor material.

14. The improvement set forth in claim 8, wherein each of said projecting means is a length of reinforcing bar stock.

15. Support means for engaging and restraining underground geologic material, said support means comprising: a cable sling extending across the underground geologic material, said cable sling having opposite terminal ends disposed in bore holes in the geologic material; anchor means connected to said terminal ends of said cable sling and movable into said bore holes; split sleeve members receiving the cable sling adjacent said anchor means and being positioned for driving said anchor means into the bore holes and thereby tensioning the cable sling, said split sleeve members engaging the surfaces of the bore holes for increasing the resistance of said anchor means to displacement due to geologic material shift and movement; and means between the cable sling and the geologic material acting to block the cable sling in position.

16. The support means set forth in claim 15, wherein said anchor means connected to said terminal ends of said cable sling are dissimilar for effecting a substantially unsymmetrical anchorage for said cable sling.

17. A cable sling assembly for installation in a geologic mass in bore holes formed in such mass, said assembly comprising: a flexible cable; drive means secured to said cable adjacent the opposite ends of said cable, said drive means having a dimension allowing easy passage thereof in a bore hole of the geologic mass; elongated split sleeve members having a driving end portion and an opposite free end, said members being mounted on said cable by receiving said cable through said elongated split with said driving end presented toward said drive means, said elongated split sleeve members having driving engagement on said drive means and said split sleeve members having a dimension larger than the bore hole for establishing retention of said drive means.

18. The cable sling assembly set forth in claim 17, wherein said drive means secured at one end of said cable is a block, and said drive means secured at the opposite end of said cable is a split block and a wedge element for expanding said split block.

19. The cable sling assembly set forth in claim 17, wherein said drive means includes extension means in position for preceding said drive means passage into a bore hole; and auxiliary anchor means for retaining said extension means in a bore hole.

20. The cable sling assembly set forth in claim 19, wherein said auxiliary anchor means comprises a portion of said cable and settable anchor material for cooperating with said portion of said cable.

21. The cable sling assembly set forth in claim 17, wherein said drive means is a split block, and said driving end portion of said split sleeve member is wedge-shaped for engaging in and expanding said split block.

* * * * *

UNITED STATES PATENT AND TRADEMARK OFFICE

CERTIFICATE OF CORRECTION

PATENT NO. : 4,265,571

DATED : May 5, 1981

INVENTOR(S) : James J. Scott

It is certified that error appears in the above-identified patent and that said Letters Patent are hereby corrected as shown below:

Column 6, line 23, Claim 1, delete "long" and substitute therefor -- along--

Signed and Sealed this

*Fourteenth* Day of *July 1981*

[SEAL]

*Attest:*

GERALD J. MOSSINGHOFF

*Attesting Officer*

*Commissioner of Patents and Trademarks*